US008096776B2

(12) United States Patent
Bluck et al.

(10) Patent No.: US 8,096,776 B2
(45) Date of Patent: Jan. 17, 2012

(54) TURBINE BLADE ASSEMBLY

(75) Inventors: Richard Bluck, Welton (GB); Scott Charlton, Newark (GB)

(73) Assignee: Siemens Aktiengesellschaft, Munich (DE)

( * ) Notice: Subject to any disclaimer, the term of this patent is extended or adjusted under 35 U.S.C. 154(b) by 459 days.

(21) Appl. No.: 12/312,048

(22) PCT Filed: Aug. 31, 2007

(86) PCT No.: PCT/EP2007/059086

§ 371 (c)(1),
(2), (4) Date: Apr. 23, 2009

(87) PCT Pub. No.: WO2008/049677

PCT Pub. Date: May 2, 2008

(65) Prior Publication Data

US 2010/0047073 A1 Feb. 25, 2010

(30) Foreign Application Priority Data

Oct. 26, 2006 (EP) ..... 06022426

(51) Int. Cl.
*B63H 1/20* (2006.01)
*B63H 13/00* (2006.01)

(52) U.S. Cl. ..... 416/221; 416/219 R; 416/220 R

(58) Field of Classification Search ..... 416/221, 416/219 R, 220 R
See application file for complete search history.

(56) References Cited

U.S. PATENT DOCUMENTS

| | | | | |
|---|---|---|---|---|
| 3,656,865 | A | 4/1972 | Spears, Jr. | |
| 3,807,898 | A | 4/1974 | Guy et al. | |
| 3,814,539 | A * | 6/1974 | Klompas | 416/95 |
| 4,108,571 | A * | 8/1978 | Mawson | 416/221 |
| 4,189,282 | A * | 2/1980 | Benoist et al. | 416/221 |
| 4,470,756 | A * | 9/1984 | Rigo et al. | 416/220 R |
| 4,502,841 | A * | 3/1985 | Kebedjis | 416/220 R |
| 4,940,389 | A * | 7/1990 | Luxenburger | 416/193 A |
| 5,018,941 | A * | 5/1991 | Heurtel et al. | 416/220 R |
| 5,256,035 | A * | 10/1993 | Norris et al. | 416/220 R |
| 5,662,458 | A | 9/1997 | Owen | |

FOREIGN PATENT DOCUMENTS

| | | | |
|---|---|---|---|
| DE | 10 2004 036 389 | A1 | 3/2006 |
| EP | 1584794 | A1 | 10/2005 |
| EP | 1 657 404 | A1 | 5/2006 |
| GB | 905 582 | A | 9/1962 |
| GB | 2095763 | A1 | 12/1982 |
| GB | 2 258 273 | A | 2/1993 |
| RU | 97112384 | A | 6/1999 |
| RU | 2403404 | C1 | 11/2010 |

OTHER PUBLICATIONS

Communication from Gorodissky & Partners, Jul. 6, 2011, p. 1-2, 1-3, 1, 1-4.
Communication from Sonderhoff & Einsel, Feb. 24, 2011, pp. 1, 1-6.

* cited by examiner

*Primary Examiner* — Nitin Parekh

(57) ABSTRACT

A turbine blade assembly, in particular of a gas turbine, is provided. The turbine blade assembly includes a turbine disc with rotor blades inserted into notches of the turbine disc and locking plates that are placed inside circular grooves with rims in the turbine disc and in the rotor blade. The edges of the locking plates that are oriented towards the center of the turbine disc are castellated by providing teeth and accordingly a part of the rim of the circular groove of the turbine disc is also castellated by providing gaps and whereby the gaps of the rim match the teeth of the locking plates. The locking plates have a spring-back force to provide both locking and sealing capabilities during engine operation.

9 Claims, 3 Drawing Sheets

A-A

TURBINE BLADE ASSEMBLY

CROSS REFERENCE TO RELATED APPLICATIONS

This application is the US National Stage of International Application No. PCT/EP2007/059086, filed Aug. 31, 2007 and claims the benefit thereof. The International Application claims the benefits of European Patent Office application No. 06022426.8 EP filed Oct. 26, 2006, both of the applications are incorporated by reference herein in their entirety.

BACKGROUND OF THE INVENTION

The invention relates to turbine blade assemblies, in particular for gas turbines.

Blade locking in turbine discs must be performed to ensure blades do not become loose during engine operation. For high pressure turbine blades, locking plates have traditionally been employed to provide both security and sealing of cooling air to prevent excessive leakages, these plates being assembled using a sequential build technique. However, where blades are assembled into discs as a full engine set (e.g. where root and platform angles are different) it is not possible to fit traditional plates as the retaining grooves in the disc and blade are full rings—therefore a new method is required.

Blade locking has traditionally been achieved using locking strips to secure pairs of blades to the disc or where improved sealing is required the use of locking plates has been employed to secure blades and discs locating in circumferential grooves on the component parts.

EP 1 657 404 A1 discloses a rotor of a turboengine with turbine blades mounted to axial grooves in the rotor. The turbine blades are prevented from moving in the axial direction by locking plates. The rhomboid locking plates are inserted into a space between two grooves in the rotor and the turbine blades and then rotated so that the edges of the rhomboids engage into the grooves to secure the turbine blades.

U.S. Pat. No. 5,662,458 discloses a bladed rotor for a high pressure compressor of a gas turbine engine with retention plates. The retention plates are carried in radially inner and outer slots and prevent axial movement of the blade roots in their slots. When all the retention plates have been inserted into the loading slot, a locking member is inserted to close the gap between the two last retention plates. The locking member is placed between an adjacent pair of retention plates to prevent their circumferential movement relative to the disc. The locking member has a lower portion that corresponds in shapes with the loading slot. It is of greater axial extend than the loading slot so that it protrudes into the radial inner slot.

GB 2 258 273 A discloses a locking arrangement for the rotor blades of a gas turbine. The locking arrangement comprises a plate which extends circumferentially over the roots of several blades. The blades are trapped between retaining hooks integral with the rotor disc and the blade roots. The plates each have a reciliently mounted hook which, when in position, prevents rotation of the plate. The plate can be released by depression of the hook.

GB 905 582 A discloses a turbine blade assembly, in particular for a gas turbine, with a turbine disc and rotor blades inserted into notches of the turbine disc and locking plates that are placed inside circular grooves with rims in the turbine disc and in the rotor blades.

U.S. Pat. No. 3,656,865 A discloses a locking plate for mounting in retaining grooves in the disc whose outer flange is discontinuous as intersected by the blade slots. The locking plate has teeth on its radially outer side that allow the insertion of the locking plates after all the blades have been mounted on the disc.

OBJECTIVE OF THE INVENTION

The objective of the invention is to provide an improved turbine bladed disc assembly with respect to sealing and locking, where the configuration of the turbine blade design implies that all blades can be installed in the turbine disc simultaneously.

This objective is solved by a turbine blade assembly according to the claims The depending claims define further developments of the invention.

An inventive turbine blade assembly, in particular of a gas turbine, comprises a turbine disc with rotor blades inserted into grooves of the turbine disc and locking plates that are placed inside circular grooves with rims in the turbine disc and the rotor blades. The edges of the locking plates that are orientated towards the center of the turbine disc are castellated by providing teeth. A part of the rim of the circular groove of the turbine disc is also castellated by providing gaps and the gaps of the rim match the teeth of the locking plates.

The locking plates retain the blades during engine operation which is necessary for security. The locking plates also provide sealing of cooling air to prevent excessive leakages. The castellated edges of the locking plates allow for insertion into the castellated insertion part of the rim of the circular groove of the turbine disc even after all turbine blades are mounted to the disc. The gaps of the insertion part and the teeth of the locking plates correspond to allow for insertion of the locking plates into the grooves.

In an advantageous development of the invention the locking plates are sprung. This retains the blades during engine operation. In addition, the spring-back will provide the required force to seal against the disc rear face and prevent leakages of the high pressure cooling air to cool the internals of the high pressure turbine blades.

Another advantage is the sprung locking plates can be easily formed from sheet metal giving a significant cost reduction to machined alternatives.

The locking plates may comprise at least one bent portion at or near to the castellated edge and/or at or near to the edge lying opposite the castellated edge to provide springing.

The locking plates may also comprise a flat portion outside the at least one bent portion which allows for flat rest against the turbine disc and therefore provides good sealing.

Further the locking plates may be fixed by a final deformable closing plate. The deformable closing plate is placed in the castellated part of the rim of the circular groove of the turbine disc to secure the locking plates in a circumferential direction.

Further features, characteristics and advantages of the invention become clear from the following description of the embodiments of the invention in reference to the accompanying drawings.

DETAILED DESCRIPTION OF THE EMBODIMENT

Figure 1:
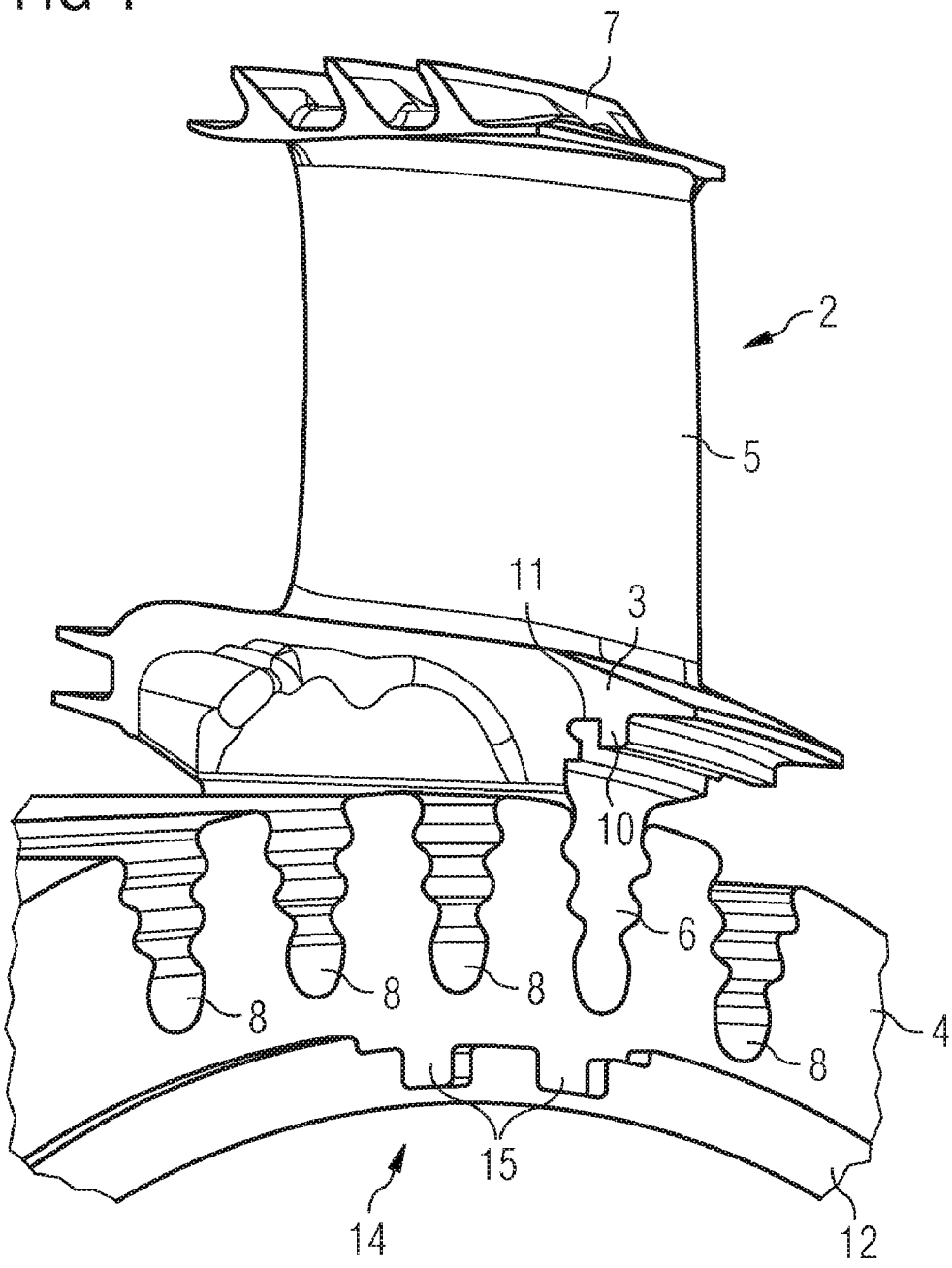
FIG. 1 shows a perspective view of a turbine blade assembly.

FIG. 1 shows a turbine blade assembly with a turbine blade 2, comprising a top portion 7, an airfoil 5, a platform 3, a groove 11 with a rim 10 and a turbine blade root 6 and a turbine disc 4 comprising notches 8 and a circular groove 13 (see FIG. 3) with a rim 12 comprising a castellated part 14 with gaps 15.

The turbine blade 2 is used in a gas turbine where hot pressurized gas is guided towards turbine blades with airfoils that are fixed on a rotor to move the turbine blades and thus drive the rotor. The rotor comprises several turbine discs 4. The turbine blades 2 are mounted to a turbine disc 4 by their turbine blade roots 6 that are inserted into notches 8 of the turbine disc 4. Although the notches 8 in FIG. 1 are oriented axially through the disc 4 so that they extend more or less perpendicular to the end and back faces of the disc 4 they may sometimes be oriented such that they extend more or less tangential to the end and back faces of the disc.

The platform 3 of the turbine blade 2 is placed substantially parallel to the circumferential area of the turbine disc 4 between the airfoil 5 and the turbine blade root 6. The groove in the turbine blade 2 forming a segment of a full groove 11 that runs along the bottom side of the platform 3 when all the turbine blades 2 have been assembled. The rim 10 of the groove 11 is placed rectangular to the base of the groove 11. The circular groove 13 in the turbine disc 4 is spaced from the circumference of the turbine disc 4 and has a rim 12 which is rectangular to the base of the groove 13. The rim 12 has a castellated part 14 with gaps 15.

When the turbine blade 2 is assembled to the turbine disc 4 the groove 11 in the turbine blade 2 is in the same plane as the circular groove 13 in the turbine disc 4. The grooves 11 and 13 and the castellated part 14 with gaps 15 are provided for inserting and holding locking plates as shown in FIG. 2.

Figure 2:
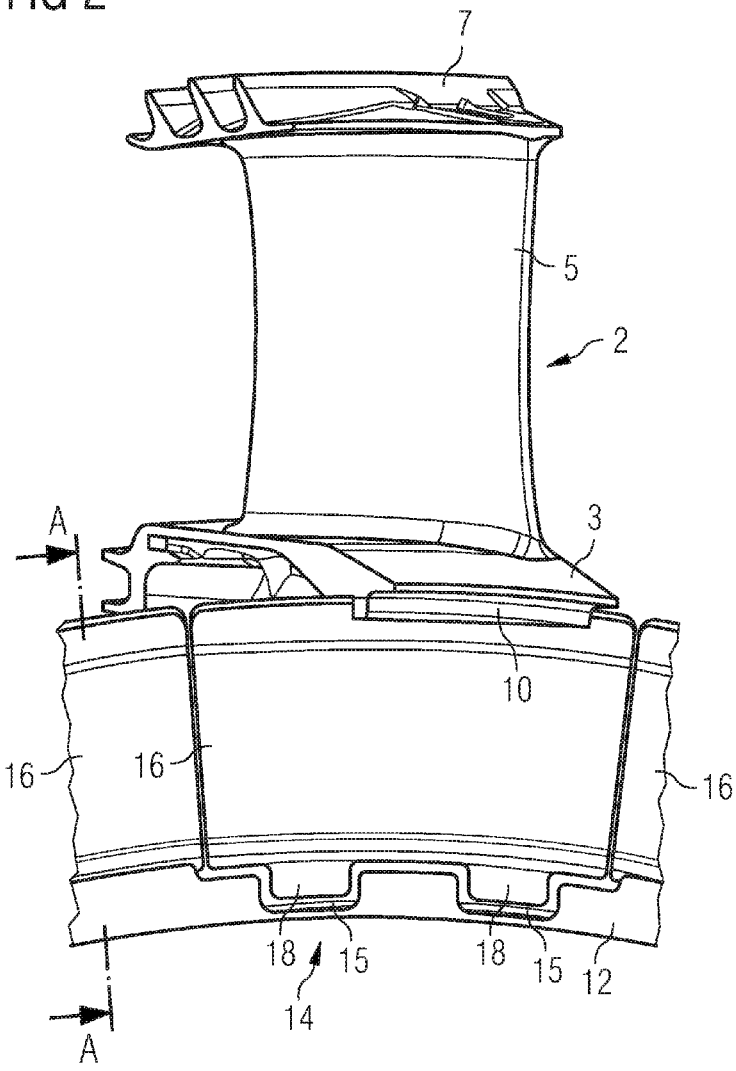
FIG. 2 shows a perspective view of a turbine blade assembly with locking plates.

In FIG. 2 a turbine blade assembly with a turbine blade 2, a turbine disc 4 and locking plates 16 is shown.

Figure 3:
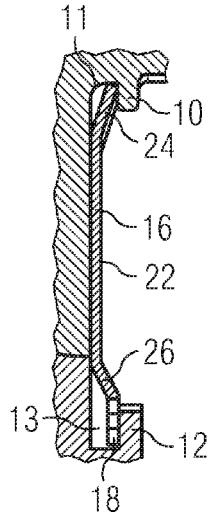
FIG. 3 shows a sectional view of a turbine blade assembly with a locking plate.

The turbine blade 2 is mounted to the turbine disc 4 as shown in FIG. 1 and FIG. 3. The locking plates 16 according to the present embodiment are formed from sheet metal. They comprise a substantially flat body 22 with rounded corners for better handling. They further comprise a castellated edge and a concave edge, which is a bent portion 24 of the body 22, opposite to the castellated edge. The castellated edge comprises two teeth 18. A bent portion 26 is located between the flat body 22 and the teeth 18 of the castellated edge. However, the bent portion could also extend into the teeth or could be formed only in the teeth.

The locking plates 16 are inserted into the circular grooves 11 and 13 by placing the concave edge behind the rim 12 of the groove 11 and then inserting the castellated part 14 into the circular groove 13 of the turbine disc 4 by placing the teeth 18 into the gaps 15. The locking plate is then moved around in a circumferential direction and the next locking plate can be inserted. As the plates 16 are preformed they provide a spring-back force and must be press fitted into the groove assembly. When inserted into the grooves the spring-back presses the flat portion 22 against the face of the disc 4 what provides a good sealing effect.

FIG. 3 shows a sectional view of a turbine blade assembly according to FIG. 2 along the line A-A after inserting the locking plates. Here, it can be easily seen that the locking plate 16 is a flat plate bent at its outer portions. In the region of the castellated edge the body 22 is bent twice with an intermediate bent portion 24 extending with an angle to the flat portion of the body 22 and with the teeth 18 bent such as to be parallel to the flat portion of the body 22. The edge lying opposite to the castellated edge is formed by a bent portion 26 which is bent such as to extend with an angle with respect to the flat portion of the body 22. By the bending, the locking plate obtains a concave shape which provides the spring-back for pressing it against the disc 4. By engaging the grooves 11 and 13 the bent portion 24 and the teeth 18 hold the locking plate in place.

Figure 4:
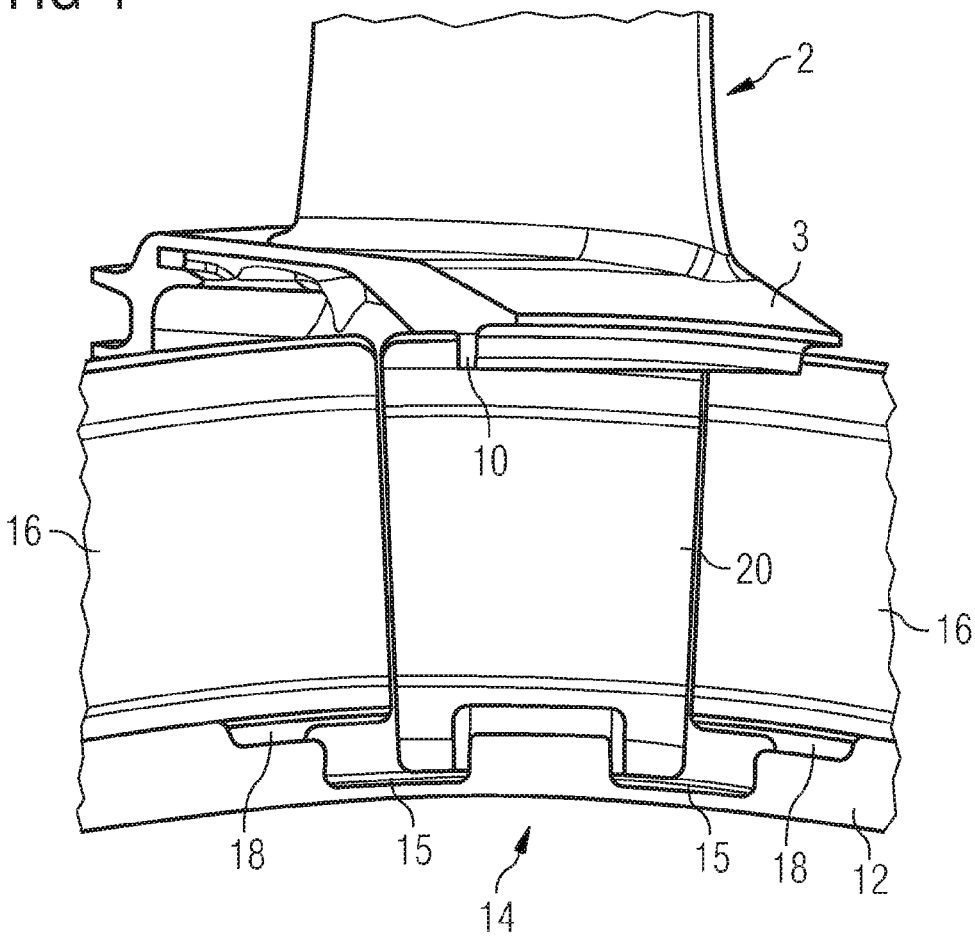
FIG. 4 shows a turbine blade assembly with locking plates and a closing plate.

FIG. 4 shows a turbine blade assembly with a turbine blade 2, a turbine disc 4 and locking plates 16.

There is a closing plate 20 provided that closes the gap between adjacent locking plates 16. The closing plate 20 is provided with a deformable lower part so that it can be inserted behind the tooth of the castellated part 14 of the rim 12 of the groove 11 in the turbine disc 4.

In operation the locking plates 16 and the closing plate 20 retain the turbine blades 2 in their notches 8 (see FIG. 1) and prevent the turbine blades from moving in an axial direction.

The invention claimed is:

1. A turbine blade assembly, comprising:

a turbine disc with a rotor blade inserted into a notch of the turbine disc; and a locking plate, placed inside a plurality of circular grooves with a plurality of rims located in both the turbine disc and in the rotor blade, wherein an edge of the locking plate that is oriented towards a center of the turbine disc is castellated by providing a plurality of teeth, wherein a part of a rim of the circular groove of the turbine disc is also castellated by providing a plurality of gaps and in that the plurality of gaps of the rim match the plurality of teeth of the locking plate, wherein the locking plate is sprung and thereby is engaged and further comprises a bent portion which is located at or near the castellated edge and/or the bent portion is located at or near an edge lying opposite to the castellated edge, the bent portion extending into the plurality of teeth.

2. A turbine blade assembly as claimed in claim 1, wherein the turbine blade assembly is a gas turbine.

3. A turbine blade assembly as claimed in claim 1, wherein the locking plate further comprises a flat body with a plurality of rounded corners.

4. A turbine blade assembly as claimed in claim 1, wherein the locking plate provides a spring-back force, and wherein when the locking plate is inserted into the plurality of grooves, the spring-back force presses the flat body of the locking plate against a face of the turbine disc providing a sealing effect.

5. A turbine assembly as claimed in claim 1, wherein the bent portion is formed in the plurality of teeth.

6. A turbine assembly as claimed in claim 1, wherein the locking plate is flat outside the bent portion.

7. A turbine assembly as claimed in claim 1, wherein the locking plate is formed from a sheet metal.

8. A turbine assembly as claimed in claim 1, wherein the locking plate is held in place by a deformable closing plate, wherein the deformable closing plate is placed in a castellated part of the rim of the circular groove of the turbine disc to secure the locking plate in a circumferential direction.

9. A turbine assembly as claimed in claim 1, further comprising a closing plate which closes a further gap formed between two adjacent locking plates.

* * * * *